US007775297B2

(12) United States Patent
Hopwood et al.

(10) Patent No.: US 7,775,297 B2
(45) Date of Patent: Aug. 17, 2010

(54) MULTIPLE INPUT SCALING AUTODRILLER

(75) Inventors: Fergus Hopwood, Houston, TX (US); Phil Martin, Houston, TX (US); Richard Lewis, Tomball, TX (US)

(73) Assignee: Omron Oilfield & Marine, Inc., Houston, TX (US)

( * ) Notice: Subject to any disclaimer, the term of this patent is extended or adjusted under 35 U.S.C. 154(b) by 600 days.

(21) Appl. No.: 11/567,488

(22) Filed: Dec. 6, 2006

(65) Prior Publication Data

US 2008/0135290 A1 Jun. 12, 2008

(51) Int. Cl.
*E21B 44/00* (2006.01)

(52) U.S. Cl. ..... 175/24; 175/25; 175/26; 175/27

(58) Field of Classification Search ..... 175/24, 175/25, 26, 27
See application file for complete search history.

(56) References Cited

U.S. PATENT DOCUMENTS 2,005,889 A 6/1935 Dillon et al.
3,233,183 A 2/1966 Quate
4,165,789 A 8/1979 Rogers
4,535,972 A 8/1985 Millheim et al.
4,662,608 A 5/1987 Ball
5,474,142 A 12/1995 Bowden
6,382,331 B1 * 5/2002 Pinckard ..... 175/27

OTHER PUBLICATIONS

SPE 20107; "Field Experiences With Computer-Controlled Drilling"; J.F. Brett, et al.; Dated Mar. 8-9, 1990; pp. 197-212.

* cited by examiner

*Primary Examiner*—David J Bagnell
*Assistant Examiner*—Yong-Suk Ro
(74) *Attorney, Agent, or Firm*—Osha Liang L.L.P.

(57) ABSTRACT

A wellbore drilling system is disclosed herein, in which the system includes a weight on bit controller configured to generate a normalized weight on bit output, a drilling torque controller configured to generate a normalized toque on bit output, and a differential pressure controller configured to generate a normalized differential pressure output. The system further includes a rate of penetration controller that is configured to multiply a rate of penetration setpoint with the normalized weight on bit output, the normalized torque on pit output, and the normalized differential pressure output to generate a rate of penetration output.

24 Claims, 7 Drawing Sheets

MULTIPLE INPUT SCALING AUTODRILLER

BACKGROUND

1. Field of the Disclosure

Embodiments of the present disclosure relate generally to drilling boreholes, or wellbores, through subsurface formations. More particularly, embodiments of the present disclosure relate to a method and a system for controlling the rate of release of a drillstring to maintain a rate of penetration that is within a selected set of parameters during drilling.

2. Background Art

Drilling wells in subsurface formations for oil and gas wells is expensive and time consuming. Formations containing oil and gas are typically located thousands of feet below the earth's surface. Therefore, thousands of feet of rock and other geological formations must be drilled through in order to establish production. While many operations are required to drill and complete a well, perhaps the most important is the actual drilling of the borehole. The costs associated with drilling a well are primarily time dependent. Accordingly, the faster the desired penetration depth is achieved, the lower the cost for drilling the well. However, cost and time associated with well construction may increase substantially if wellbore instability problems or obstacles are encountered during drilling. Successful drilling requires achieving a penetration depth as fast as possible but within the safety limits defined for the drilling operation.

Achieving a penetration depth as fast as possible during drilling requires drilling at an optimum rate of penetration ("ROP"). The ROP achieved during drilling depends on many factors including, but not limited to, the axial force applied at the drill bit known in the industry as the weight on bit ("WOB"). As disclosed in U.S. Pat. No. 4,535,972 issued to Millheim, et al., ROP generally increases with increasing WOB until a maximum beneficial weight on bit is reached, thereafter decreasing with further weight on bit. Thus, generally for a given wellbore, a particular WOB exists that will achieve a maximum ROP.

However, the ROP may be dependant on various factors in addition to the WOB. For example, the ROP may depend upon the geological composition of the formation being drilled, the geometry and material of the drill bit, the rotational speed ("RPM") of the drill bit, the amount of torque applied to the drill bit, and the pressure and rate of flow of drilling fluids in and out of the wellbore. One of ordinary skill in the art will appreciate that because of these (and other) drilling variables, an optimal WOB for one set of drilling conditions may not be optimal for another set of conditions.

Referring initially to FIG. 1, a rotary drilling system 10 including a land-based drilling rig 11 is shown. While drilling rig 11 is depicted in FIG. 1 as a land-based rig, it should be understood by one of ordinary skill in the art that embodiments of the present disclosure may apply to any drilling system including, but not limited to, offshore drilling rigs such as jack-up rigs, semi-submersible rigs, drill ships, and the like. Additionally, although drilling rig 11 is shown as a conventional rotary rig, wherein drillstring rotation is performed by a rotary table, it should be understood that embodiments of the present disclosure are applicable to other drilling technologies including, but not limited to, top drives, power swivels, downhole motors, coiled tubing units, and the like.

As shown, drilling rig 11 includes a mast 13 supported on a rig floor 15 and lifting gear comprising a crown block 17 and a traveling block 19. Crown block 17 may be mounted on mast 13 and coupled to traveling block 19 by a cable 21 driven by a draw works 23. Draw works 23 controls the upward and downward movement of traveling block 19 with respect to crown block 17, wherein traveling block 19 includes a hook 25 and a swivel 27 suspended therefrom. Swivel 27 may support a Kelly 29 which, in turn, supports drillstring 31 suspended in wellbore 33.

Typically, drillstring 31 is constructed from a plurality of threadably interconnected sections of drill pipe 35 and includes a bottom hole assembly ("BHA") 37 at its distal end. Bottom hole assembly 37 may include stabilizers, weighted drill collars, formation measurement devices, downhole drilling motors, and a drill bit 41 connected at its distal end. It should be understood that the particular configuration and components of BHA 37 are not intended to limit the scope of the present disclosure.

During drilling operations, drillstring 31 may be rotated in borehole 33 by a rotary table 47 that is rotatably supported on rig floor 15 and engages Kelly 29 through a Kelly bushing. Alternatively, a top drive assembly (not shown) may directly rotate and longitudinally displace drillstring 31 absent Kelly 29. The torque applied to drillstring 31 by drilling rig 11 to rotate drillstring 31 is often referred to as rotary torque or drilling torque. Furthermore, many BHAs 37 may include sensors to measure the amount of torque applied to drill bit 41, known in the industry as the torque on bit.

Drilling fluid, often referred to as drilling "mud," is delivered to drill bit 41 through a bore of drillstring 31 by mud pumps 43 through a mud hose 45 connected to swivel 27. In order to drill through a formation 40, rotary torque and axial force may be applied to bit 41 to cause cutting elements disposed on bit 41 to cut into and break up formation 40 as bit 41 is rotated. Cuttings produced by bit 41 are carried out of borehole 33 through an annulus formed between drillstring 31 and a borehole wall 36 by the drilling fluid pumped through drillstring 31.

As is well known to those skilled in the art, the weight of drillstring 31 may be greater than the optimum or desired weight on bit 41 for drilling. As such, part of the weight of drillstring 31 may be supported during drilling operations by lifting components of drilling rig 11. Therefore, drillstring 31 may be maintained in tension over most of its length above BHA 37. Furthermore, because drillstring 31 may exhibit buoyancy in drilling mud, the total weight on bit may be equal to the weight of drillstring 31 in the drilling mud minus the amount of weight suspended by hook 25 in addition to any weight offset that may exist from contact between drillstring 31 and wellbore 33. The portion of the weight of drillstring 31 supported by hook 25 is typically referred to as the "hook load" and may be measured by a transducer integrated into hook 25.

Furthermore, drilling system 10 may include at least one pressure sensor 38, a processor 34, and a drillstring release controller 46. Processor 34 may be any form of programmable computer including, but not limited to, a general purpose computer, a programmed-for-purpose computer, a programmable logic controller ("PLC"), an embedded processor, or a software program. Processor 34 may be operatively connected to drillstring release controller 46 in the form of a brake band controller or a hydraulic/electric motor coupled to drawworks 23.

As shown, pressure sensor 38 may be provided in BHA 37 located above drill bit 41. As such, pressure sensor 38 may be operatively coupled to a measurement-while-drilling system (not shown) in bottom hole assembly 37. Additional pressure sensors may be located throughout drillstring 31. Pressure measurements made by pressure sensor 38 may be communicated to equipment at the earth's surface including a processor 34 using known telemetry systems including, but not limited to, mud pressure modulation, electromagnetic transmission, and acoustic transmission telemetry. Alternatively, pressure measurements may be communicated along an electrical conductor integrated into drillstring 31.

It has been shown that the monitoring of borehole fluid pressures may aid in the diagnosis of the condition of the wellbore and help avoid potentially dangerous well control issues. Annular pressure measurements during drilling, when used in conjunction with measuring and controlling other drilling parameters, have been shown to be particularly helpful in the early detection of events such as sticking, hanging or balling stabilizers, mud problem detection, detection of cutting build-up, and improved steering performance. One value used to represent the pressure is a parameter known as the differential pressure. The differential pressure is defined as the difference in pressure between the supplied drilling fluids and the returning drilling fluids. The differential pressure is commonly referred to in the drilling industry as DeltaP or $\Delta P$.

Historically, measuring and controlling drilling parameters included a system in which a feedback value for each drilling parameter was provided by sensors along the drill line. These feedback values were then compared to setpoint values that were set by the drilling operator and when an issue arose, defined by the drilling operation limits, the operator or system would switch and adjust the drilling parameter accordingly. Some other important parameters for drilling include WOB and drilling torque. Furthermore, in systems having multiple monitored parameters, the operator would formerly switch his or her focus on only one parameter at a time. As such, while many parameters may be "monitored" at any given time, only one would "control" the release of the drillstring. Therefore, a need exists for a drilling system to allow several drilling parameters to affect the release of the drillstring simultaneously without such switching.

SUMMARY OF THE CLAIMED SUBJECT MATTER

A wellbore drilling system includes a weight on bit controller configured to generate a normalized WOB output, a drilling torque controller configured to generate a normalized TOB output, and a differential pressure controller configured to generate a normalized DeltaP output. The wellbore drilling system also includes a rate of penetration controller configured to multiply a ROP setpoint with the normalized WOB output, the normalized TOB output, and the normalized DeltaP output to generate a ROP output.

A wellbore drilling system includes a plurality of controllers, each configured to generate a normalized output. The wellbore drilling system also includes a rate of penetration controller configured to multiply a rate of penetration setpoint with the plurality of normalized outputs to generate a ROP output.

A method to control a wellbore drilling system includes generating a plurality of normalized outputs and multiplying each of the plurality of normalized outputs together. Furthermore, the method includes generating a ROP output by multiplying a product of the plurality of normalized outputs with a ROP setpoint.

A method to control a wellbore drilling system includes generating a normalized WOB output, generating a normalized TOB output, and generating a normalized DeltaP output. The method also includes multiplying the normalized WOB, the normalized TOB, and the normalized DeltaP outputs together with a ROP setpoint to generate a ROP output.

DETAILED DESCRIPTION

Figure 1:
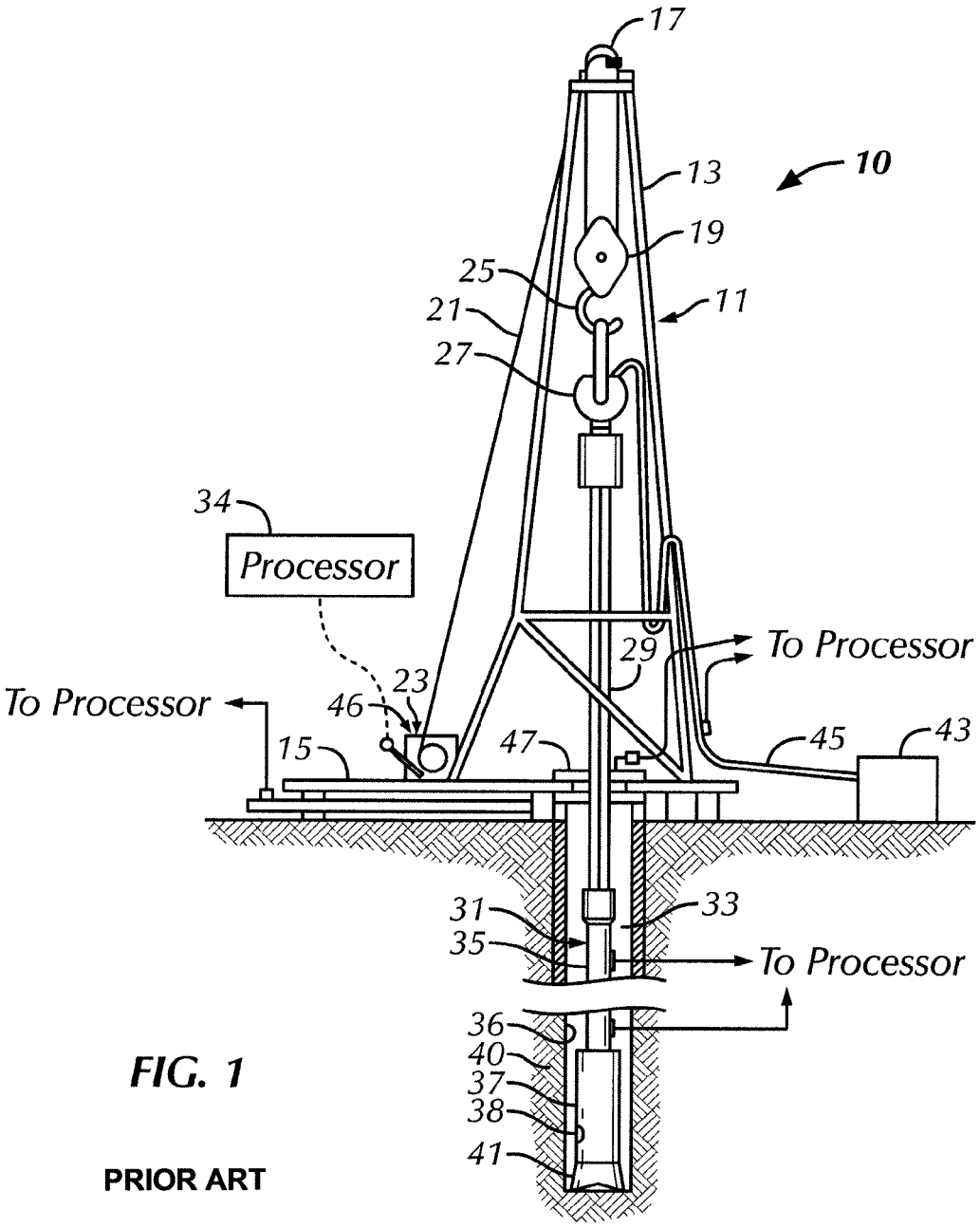
FIG. 1 PRIOR ART
FIG. 1 is a schematic view drawing of a prior-art drilling rig to drill a wellbore.
Figure 2:
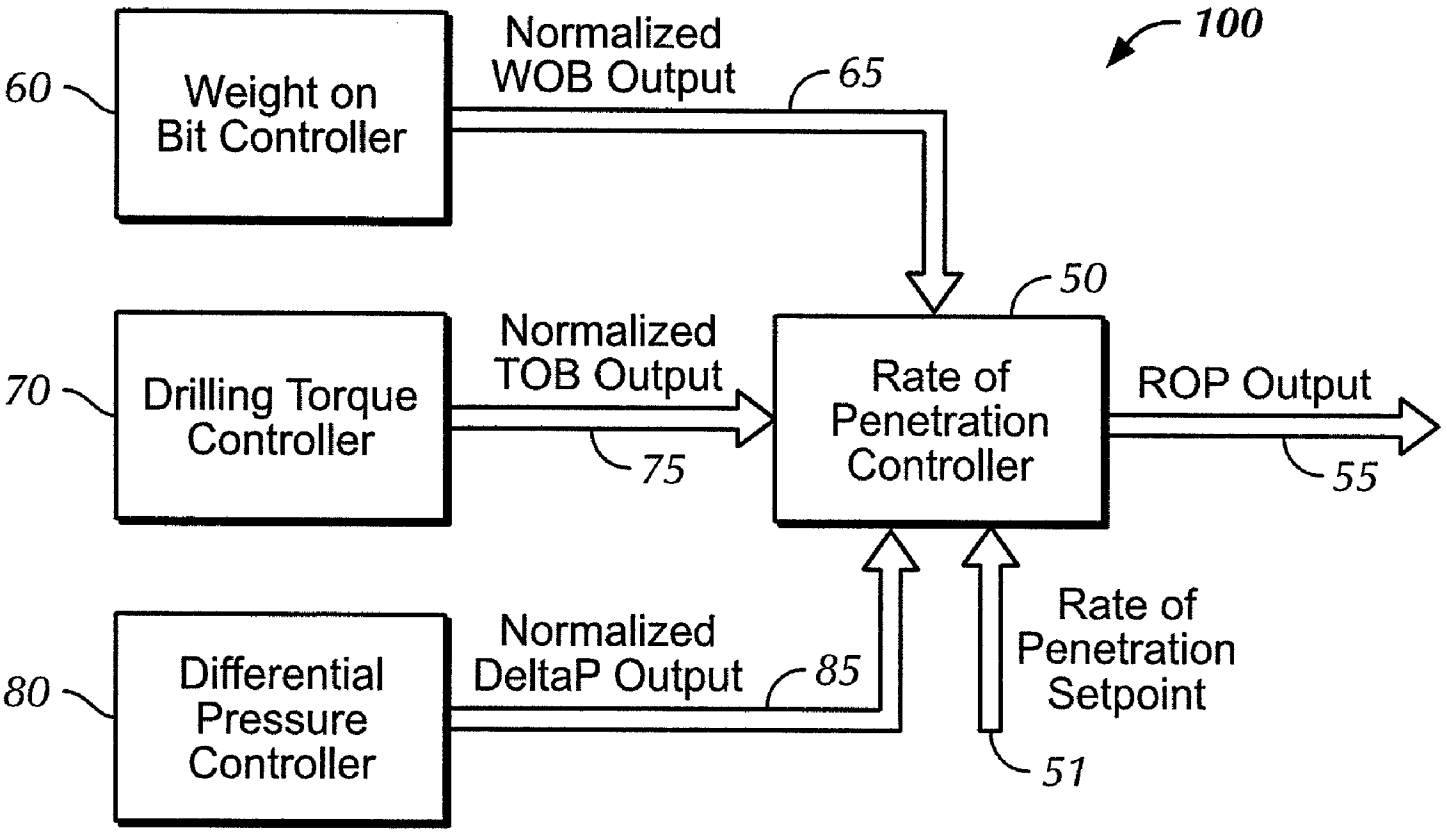
FIG. 2 is a schematic block diagram of a wellbore drilling system in accordance with embodiments of the present disclosure.

Referring now to FIG. 2, a wellbore drilling system 100 in accordance with embodiments of the present disclosure is shown schematically. Drilling system 100 includes a weight on bit controller 60, a drilling torque controller 70, a differential pressure controller 80, and a rate of penetration controller 50. Rate of penetration controller 50 may be configured to receive information from weight on bit controller 60, drilling torque controller 70, and differential pressure controller 80 and return a rate of penetration output 55.

As shown, weight on bit controller 60 generates a normalized weight on bit output 65 in response to a weight on bit input (not shown) from a WOB sensor. While the output is shown transmitted from the WOB controller 60 to ROP controller 50 as normalized WOB output 65, it should be understood by one of ordinary skill in the art, that the normalization of data from the WOB sensor of WOB controller 60 may be performed either by WOB controller 60, ROP controller 50, or an external normalization unit (not shown) located between WOB controller 60 and ROP controller 50. Furthermore, while the term "normalized" may refer to any particular scheme and scale for normalizing output across multiple data sources, selected embodiments of the present disclosure are configured to normalize WOB output 65 to a range between zero (0) and one (1).

Similarly, drilling torque controller ("TOB controller") 70 communicates with ROP controller 50. As such, TOB controller 70 receives a drilling torque input (not shown) from a sensor and converts that input to a normalized output 75 for communication to ROP controller 50. Depending on the type and configuration of the drilling apparatus used with system 100, the torque sensor in communication with TOB controller 70 may either report torque applied to the drillstring at the rig (by a top drive or a rotary table), or a sensor configured to measure the actual torque acting on the bit. It should be understood that because of frictional losses and the composition and geometry of the drillstring, the torque applied to the drillstring at the surface may not equal the torque (i.e., the torque on bit) measured at the bit. Nonetheless, in the present application, the abbreviation for torque on bit ("TOB") may be used to refer to either the drilling torque or the torque on bit, as either torque value may be received and processed by TOB controller 70. Regardless of which configuration is used, a normalization scheme will convert the sensor input into normalized output 75 for use by ROP controller 50.

Furthermore, differential pressure (DeltaP) controller 80 communicates with ROP controller 50. As such, DeltaP controller 80 receives a differential pressure input (not shown) from sensors and converts that input to a normalized DeltaP output 85 for communication to ROP controller 50. Depending on the type and configuration of the drilling apparatus used in conjunction with system 100, the differential torque inputs may be of various types and configurations. Particularly, DeltaP controller 80 may receive two separate pressure inputs and calculate the ΔP internally, or an external device may transmit a non-normalized ΔP signal to DeltaP controller 80. In one embodiment, DeltaP controller 80 subtracts a low pressure signal output from a standpipe pressure transducer and a high pressure signal output from a mud pump assembly to arrive at a value for ΔP.

Additionally, it may be possible for one or more controllers (60, 70, or 80) to produce more than one output depending on the design. Further, controllers (60, 70, and 80) may be toggled on and off by a user and therefore, at certain times, not provide a normalized output (65, 75, or 85) to rate of penetration controller 50. ROP controller 50 is configured to input normalized outputs 65, 75, and 85 and a rate of penetration setpoint 51. Rate of penetration setpoint 51 is a value that is input into ROP controller 50 and, in one embodiment is used as a "target" ROP for system 100.

As such, ROP setpoint 51 may be selected through one of many methods known to one of ordinary skill in the art. Particularly, ROP setpoint 51 may be an estimated maximum ROP for the formation the drill bit is expected to be drilling or may be a value selected based upon experience with similar formations in the same region. Regardless of how determined, setpoint 51 is a value that, absent controller system 100, would control the ROP of the drillstring into the formation. Such control may come in the form of varying the hook load of a conventional drilling apparatus, or varying the amount of thrust or lift in a top drive drilling apparatus. In one embodiment, ROP setpoint 51 represents a maximum value for ROP for control system 100, with controllers (60, 70, and 80) acting to retard that ROP value when necessary.

With normalized outputs (65, 75, and 85) and ROP setpoint 51 as inputs, rate of penetration controller 50 will produce a rate of penetration output 55. In one embodiment, ROP controller 50 will take ROP setpoint 51 and multiply it by normalized outputs 65, 75, and 85 to obtain ROP output 55, In this embodiment, controller outputs 65, 75, and 85 are normalized to be between zero and one, such that their product will also exist between zero and one. Therefore, the product of normalized outputs 65, 75, and 85 with ROP setpoint 51 (i.e., the ROP output 55) will be between zero and the value of ROP setpoint 51. Thus, inputs to controllers 60, 70, and 80 will be normalized such that their corresponding normalized outputs 65, 75, and 85 will be "scaled" as maximum and/or minimum permissive values for WOP, TOB, and DeltaP are reached.

For example, if a WOB transducer reports a range between 0 and 100 with 80 being the maximum allowable WOB allowed, WOB controller 60 may be configured to output a normalized WOB output 65 of (0) when the transducer reports an output of 80 and above and a normalized WOB output of (1) when the transducer reports an output less than 30. As such, one of ordinary skill in the art would know to scale the normalized WOB output between (0) and (1) for transducer outputs between 30 and 80 depending on how critical those reported WOB values are to the success of drilling. Normalized TOB and DeltaP outputs (75 and 85) may be similarly scaled to reflect their importance and how much affect they should have on ROP output 55.

Figure 3:
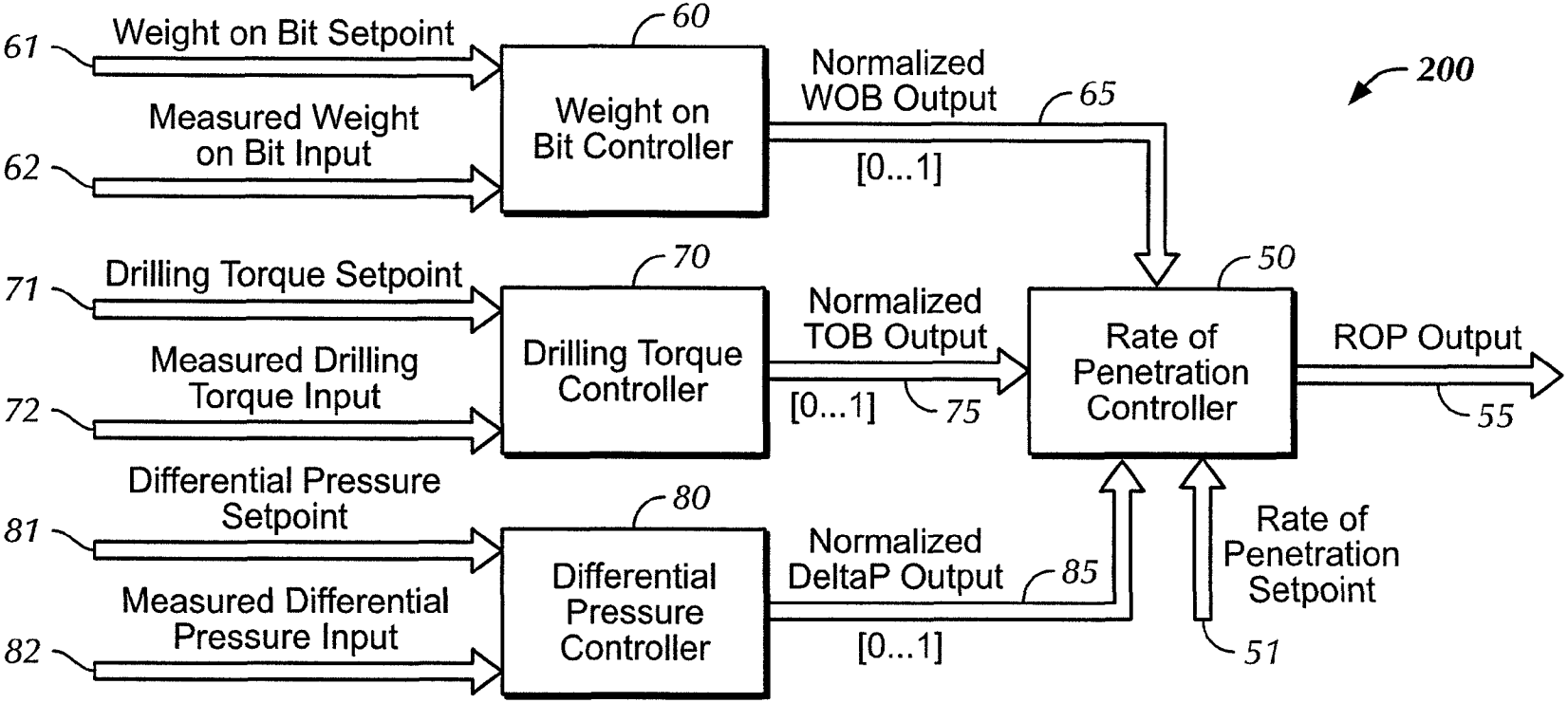
FIG. 3 is a schematic block diagram of an alternative wellbore drilling system in accordance with embodiments of the present disclosure.

Referring now to FIG. 3, an alternative embodiment of a wellbore drilling system 200 in accordance with embodiments of the present disclosure is shown having specific inputs used by controllers 60, 70, and 80 to produce their normalized outputs 65, 75, and 85, Weight on bit controller 60 is shown including a user-defined weight on bit setpoint 61 and a measured weight on bit input 62 which may be received from one or more sensors placed along the drillstring. It should be understood that a "user-defined" WOB setpoint 61 may come from a drill operator, a project or programming engineer, a computer simulation, a database of historical drilling records, or from a computer having artificial intelligence (AI) capabilities.

Similarly, drilling torque controller 70 includes a user-defined drilling torque setpoint 71 and a measured drilling torque input 72 which may be received from one or more sensors placed along the drillstring. Similarly, differential pressure controller 80 includes a user-defined differential pressure setpoint 81 and a measured differential pressure input 82. As shown in FIG. 3, normalized WOB output 65, normalized TOB output 75, and normalized DeltaP output 85 are normalized to fall between zero and one. Such normalization of inputs to ROP controller 50 between zero and one allows for a simplified system where the decimal numbers may be viewed as a percentage. For example, a normalized value of 0.453 may be interpreted as 45.3% and could then be correctly scaled and manipulated for use by drilling system 200. One of ordinary skill in the art would appreciate that the normalization could fall between other values without leaving the scope of the invention. For example, the values could be normalized between zero and three or zero and one hundred and so on.

Figure 4:
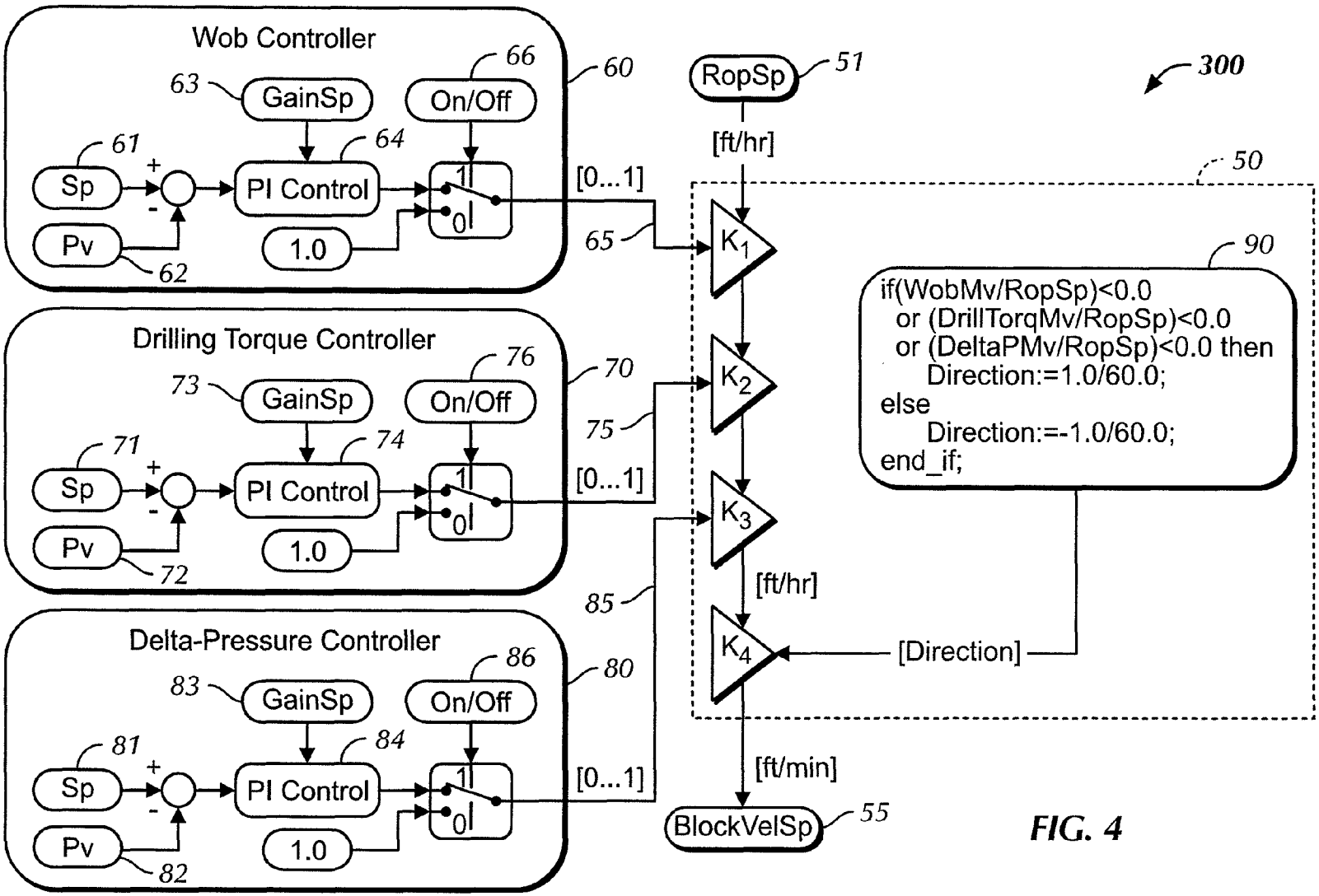
FIG. 4 is a schematic block diagram of a second alternative wellbore drilling system in accordance with embodiments of the present invention.

Referring now to FIG. 4, a wellbore drilling system 300 in accordance with an alternative embodiment of the present disclosure is shown. In FIG. 4, the internal processes of controllers 60, 70, and 80 to create the outputs 65, 75, and 85 are shown. For example, WOB controller 60 compares a measured weight on bit input 62 (also known as the present value, Pv, or feedback) with a weight on bit setpoint 61. The difference (or "error" signal) is then used in a PI control 64 to calculate a new value for a changeable input to the process that brings the process' measured value back to its desired setpoint. A gain 63 which is input into PI control 64 provides a constant used in the PI control box to generate a changeable value for adjusting the system.

One of ordinary skill in the art will appreciate that a PID controller may also be used in conjunction with any algorithm associated with either PID or PI controllers. As such, additional inputs or constants to the controller may be required. Furthermore, the output from PI Control 64 may be a value representing a percent change (up or down) required for system 300. While the output value is shown as a percentage (i.e., between zero and one), it may also be represented in other ways. For example, the output value may be a numerical value specifically representative of the shift needed to correct the "error" signal. Further, in one embodiment, the absolute value of the output value is taken and then normalized to fall between zero and one. As discussed above, this could take place within a controller (60, 70, and 80), in a separate or external normalization unit (not shown), or in rate of penetration controller 50. As would be understood by one of ordinary skill, a similar process may occur in TOB controller 70 and DeltaP controller 80.

Referring still to FIG. 4, a direction generator 90 may separately calculate a direction value for the ROP of drilling system 300. While the calculation for direction value for ROP is shown occurring within ROP controller 50, one of ordinary skill in the art will appreciate that this calculation may be externally calculated (including, but not limited to, within WOB, TOB, and DeltaP controllers 60, 70, and 80) and incorporated into normalized outputs 65, 75, and 85. Direction generator 90 may be provided such to allow drilling system 300 to not only control the rate of release of drillstring, but also, in certain circumstances, to raise the drillstring. As such, in one embodiment, direction generator 90 may output a value of either positive one or negative one, wherein positive one represents releasing the drillstring and negative one represents taking-up the drillstring. As such, direction generator 90 may be configured to output positive one during normal drilling operations and only output negative one in extraordinary circumstances. Particularly, direction generator 90 may be configured to output a negative one in the event a measured input (e.g., 62, 72, and 82) falls outside a predetermined tolerance value or if a normalized output (e.g., 65, 75, and 85) is assigned a negative value by a controller (e.g., 60, 70, and 80).

Once normalized values 65, 75, and 85, direction value 90, and rate of penetration setpoint 51 are received by ROP controller 50, they may be multiplied together to generate ROP output 55. The order in which the values are multiplied together does not matter and may therefore occur in any order. Similarly, if the operator (or another party) decides to add or remove additional normalized outputs 65, 75, and 85 representing other drilling factors as inputs to ROP controller 50, such additions may be done in any order. As normalized outputs 65, 75, and 85 in this embodiment range between zero and one, normalized outputs may be added and/or removed without affecting the scale of the remaining normalized outputs.

Furthermore, there may be additional switches 66, 76, and 86 configured to allow for parts of the system to be turned on or off. When turned off, the affected controller (either 60, 70, or 80) may send a default value of one as the normalized value (either 65, 75, or 85) to ROP controller 50. Since multiplying a value of one has no affect on the solution product, it has the same affect as turning off the controller. Nonetheless, the multiplication of the normalized values 65, 75, or 85 produces rate of penetration output 55, which may also be known as the block velocity setpoint.

Figure 5:
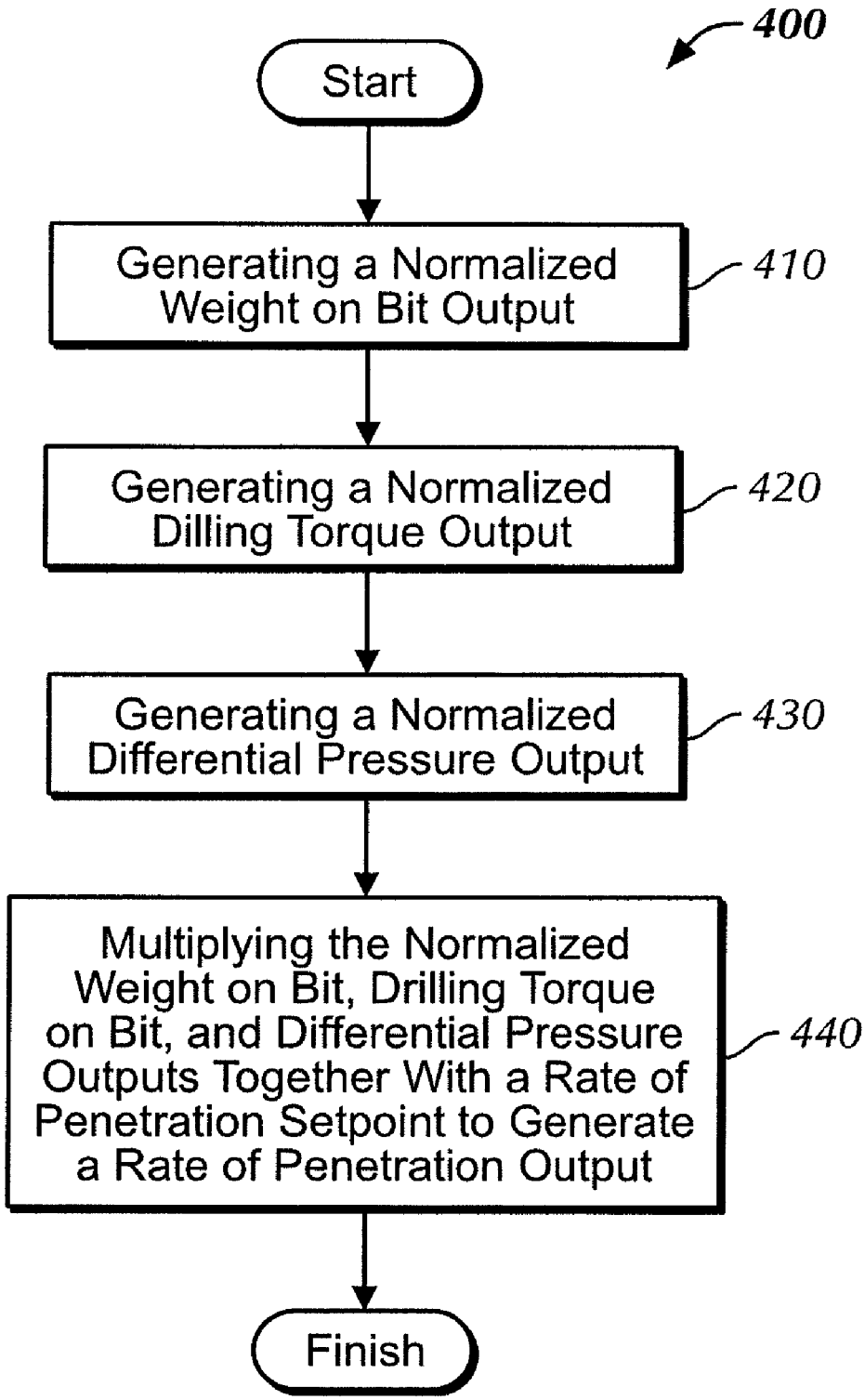
FIG. 5 is a schematic block diagram of a wellbore drilling method in accordance with embodiments of the present invention.

Referring now to FIG. 5, a block diagram depicting steps of a drilling control method 400 in accordance with embodiments of the present invention is shown. Drilling control method 400 includes generating a normalized WOB output at 410, generating a normalized TOB output at 420, and generating a normalized DeltaP at 430. Next, at 440, the normalized input values along with the rate of penetration setpoint and the direction value are multiplied to create the rate of penetration output. One of ordinary skill in the art will appreciate that the generating of the normalized weight on bit output 410, normalized drilling torque output 420, and the differential pressure output 430 may be done in any order and/or simultaneously. Additionally, any one of the three generating steps may be left out entirely, or another generating step included, without departing from the scope of the present disclosure.

The generation of a normalized weight on bit output at 410 may comprise its own set of steps. As described above in reference to FIG. 3, the generating process may receive a weight on bit setpoint and a measured weight on bit input, wherein the measured weight on bit input is a feedback value from sensors along the drillstring. Once both values are obtained, a difference between the two is used to calculate a weight on bit output.

Figure 6:
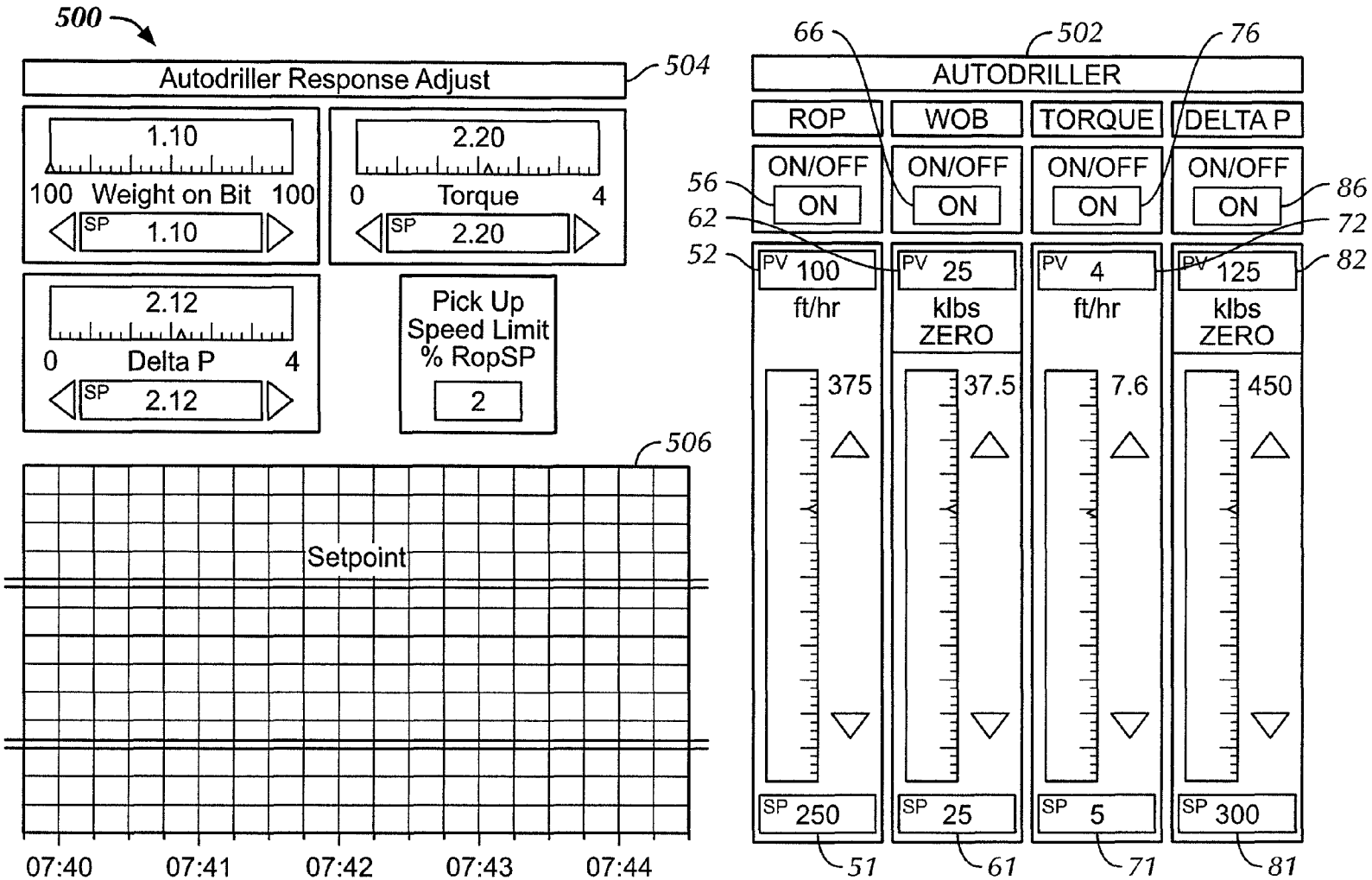
FIG. 6 depicts a display panel for use with wellbore drilling systems and methods in accordance with embodiments of the present invention.

Referring now to FIG. 6, an example of a user input interface 500 in accordance with embodiments of the present disclosure is shown. User interface 500 is designed to be used by a drill rig operator on a touch-screen monitor, but may take any form known to those of ordinary skill in the art. As such, interface 500 includes an input panel 502 where a rate of penetration setpoint 51 may be entered in manually or a corresponding slider arrow may be dragged to the desired value. A measured rate of penetration 52 is shown both graphically and numerically.

Similarly, the WOB setpoint 61, the TOB setpoint 71, and the DeltaP setpoint 81 may be entered and displayed on input panel 502 as well. Furthermore, the measured values for weight on bit 62, drilling torque 72, and differential pressure 82 may be displayed in a similar fashion. On/Off switches 66, 76, and 86 selectively engage or disengage WOB, TOB, and DeltaP factors from calculation of ROP output 52. Additionally, user interface 500 may include a response adjuster input panel 504 where an operator may speed up or slow down control loops by adjusting the default loop gains. Furthermore, user interface 500 may include a trend window 506 to allow the operator to view system response over a defined period of time. As configured and shown in FIG. 6, trend window 506 allows monitoring of system response for a period of five minutes.

Figure 7:
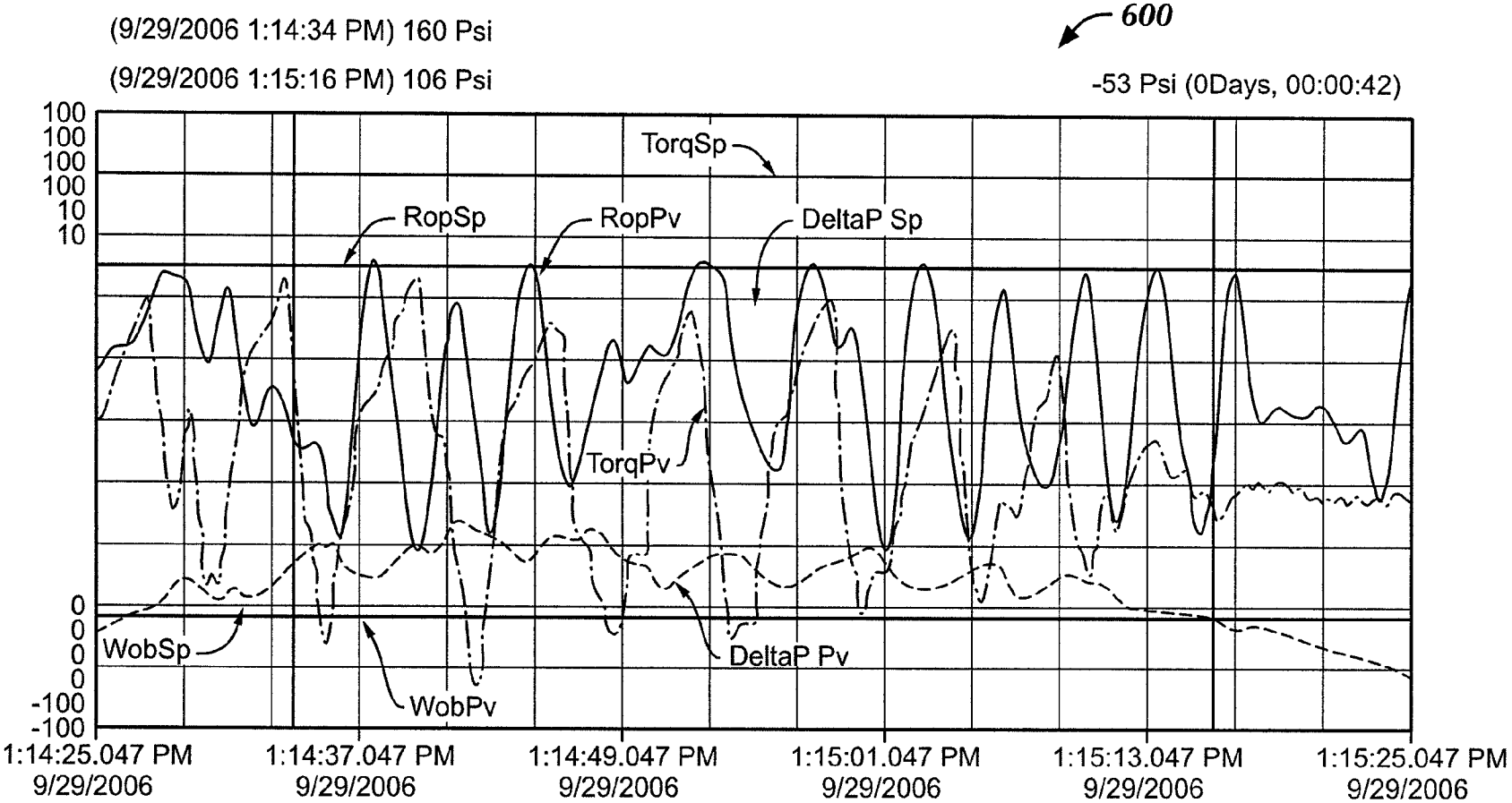
FIG. 7 depicts a alternative display panel for use with wellbore drilling systems and methods in accordance with embodiments of the present invention.

Referring briefly to FIG. 7, an alternative interface 600 for a drilling system in accordance with embodiments of the present disclosure is shown. Interface 600 is similar to interface 500 of FIG. 6 in that the various setpoints (51, 61, 71, and 81) and measured inputs (52, 62, 72, and 82) are graphically displayed. However, unlike interface 500 of FIG. 7, interface 600 includes a graphical representation of measured inputs 52, 62, 72, and 82 as a function of time with setpoints 51, 61, 71, and 81 listed in a text list at the bottom of interface 600. Thus, whereas display 500 of FIG. 6 may be preferred in circumstances where frequent control changes and modifications are necessary, display 600 of FIG. 7 may be preferred in circumstances where the drilling system is running in an "automatic" mode and such values need merely be monitored and without manipulation.

Advantageously, wellbore drilling systems in accordance with embodiments of the present disclosure may allow for several variables to simultaneously affect the drilling process without the need to switch between them. Former systems required a user (or a computer) to constantly monitor several variables and switch between them when one variable reached a critical level. Thus, much attention had to be directed to various gauges, inputs, and alarms to ensure the drilling assembly did not get too over or under loaded during operations.

Advantageously, embodiments disclosed herein may allow numerous factors to affect a drilling system without requiring any one factor to be absolutely controlling or "primary" to the system. Thus, embodiments disclosed herein may allow all variables to have input to the ROP output rather than just a single variable that is closest to a critical value. Using a drilling system in accordance with embodiments disclosed herein, several variables approaching a critical value may be used to modify the ROP output together, rather than in-turn.

While the present disclosure has been described with respect to a limited number of embodiments, those skilled in the art, having benefit of this disclosure, will appreciate that other embodiments may be devised which do not depart from the scope of the present disclosure. Accordingly, the scope of the present disclosure should be limited only by the attached claims.

What is claimed is:

1. A wellbore drilling system, comprising:

a weight on bit (WOB) controller that generates a normalized WOB output;

a drilling torque controller that generates a normalized torque on bit (TOB) output;

a differential pressure (DeltaP) controller that generates a normalized DeltaP output; and a rate of penetration (ROP) controller that multiplies a ROP setpoint with the normalized WOB output, the normalized TOB output, and the normalized DeltaP output to generate a ROP output.

2. The wellbore drilling system of claim 1, wherein the WOB output, the TOB output, and the DeltaP output are each normalized between zero and one.

3. The wellbore drilling system of claim 1, wherein the normalized WOB output is generated using a WOB setpoint and a measured WOB input.

4. The wellbore drilling system of claim 1, wherein the normalized TOB output is generated using a TOB setpoint and a measured TOB input.

5. The wellbore drilling system of claim 1, wherein the normalized DeltaP output is generated using a DeltaP setpoint and a measured DeltaP input.

6. The wellbore drilling system of claim 1, wherein the ROP output is normalized.

7. The wellbore drilling system of claim 6, wherein the ROP output is normalized between zero and one.

8. The wellbore drilling system of claim 1, further comprising;

a direction generator to output a direction value selected from the group consisting of negative one and positive one;

wherein the direction generator is configured to output a direction value of negative one if at least one of the normalized WOB output, the normalized TOB output, and the normalized DeltaP output is negative;

wherein the rate of penetration controller is configured to multiply the direction value with the ROP output.

9. A wellbore drilling system, comprising:

a plurality of controllers, wherein each controller generates a normalized output;

a rate of penetration controller that multiplies a rate of penetration setpoint with the plurality of normalized outputs to generate a ROP output.

10. The wellbore drilling system of claim 9, wherein plurality of normalized outputs are each normalized between zero and one.

11. The wellbore drilling system of claim 9, wherein each of the plurality of normalized outputs is generated using a setpoint and a measured input.

12. The wellbore drilling system of claim 9, wherein the ROP output is normalized.

13. The wellbore drilling system of claim 9, wherein the ROP output is normalized between zero and one.

14. The wellbore drilling system of claim 9, further comprising;

a direction generator to output a direction value of selected from the group consisting of negative one and positive one;

wherein the direction generator is configured to output a direction value of negative one if at least one of the plurality of normalized outputs is negative;

wherein the rate of penetration controller is configured to multiply the direction value with the ROP output.

15. A method to control a wellbore drilling system, the method comprising:

generating a plurality of normalized outputs;

multiplying each of the plurality of normalized outputs together;

generating a ROP output by multiplying a product of the plurality of normalized outputs with a ROP setpoint; and controlling the wellbore drilling system using at least one of the plurality of normalized outputs and the ROP output.

16. The method of claim 15, wherein the plurality of normalized outputs comprises a normalized WOB output.

17. The method of claim 15, wherein the plurality of normalized outputs comprises a normalized TOB output.

18. The method of claim 15, wherein the plurality of normalized outputs comprises a normalized DeltaP output.

19. A method to control a wellbore drilling system, the method comprising:

generating a normalized WOB output;

generating a normalized TOB output;

generating a normalized DeltaP output;

multiplying the normalized WOB, the normalized TOB, and the normalized DeltaP outputs together with a ROP setpoint to generate a ROP output; and controlling the wellbore drilling system using at least one of the normalized WOB output, the normalized TOB output, the normalized DeltaP output, and the ROP output.

20. The method of claim 19, wherein the generation of the normalized WOB output comprises:

receiving a WOB setpoint;

receiving a measured WOB input;

calculating a difference between the WOB setpoint and measured WOB input; and calculating a normalized WOB output based on the difference value.

21. The method of claim 19, wherein the generation of the normalized TOB output comprises:

receiving a TOB setpoint;

receiving a measured TOB input;

calculating a difference between the TOB setpoint and measured TOB input; and calculating a normalized TOB output based on the difference value.

22. The method of claim 19, wherein the generation of the normalized DeltaP output comprises:

receiving a DeltaP setpoint;

receiving a measured DeltaP input;

calculating a difference between the DeltaP setpoint and measured DeltaP input; and calculating a normalized DeltaP output based on the difference value.

23. The method of claim 22, wherein receiving the measured DeltaP input comprises:

receiving a standpipe pressure;

receiving a mud pump pressure; and subtracting the standpipe pressure from the mud pump pressure.

24. The method of claim 19, further comprising multiplying the ROP output by negative one if any one of the normalized WOB, TOB, and DeltaP outputs is negative.

US 7,775,297 B2
11 12

* * * * *